US007080496B2

(12) United States Patent
Van Scoyk

(10) Patent No.: US 7,080,496 B2
(45) Date of Patent: Jul. 25, 2006

(54) HANDGRIP AND STIRRUP SUPPORT FOR BAREBACK HORSE RIDING

(76) Inventor: Pershing Roland Van Scoyk, 7193 W. 32nd Ave., Wheat Ridge, CO (US) 80033

( * ) Notice: Subject to any disclaimer, the term of this patent is extended or adjusted under 35 U.S.C. 154(b) by 0 days.

(21) Appl. No.: 10/865,080

(22) Filed: Jun. 10, 2004

(65) Prior Publication Data

US 2005/0150196 A1 Jul. 14, 2005

Related U.S. Application Data

(60) Provisional application No. 60/535,630, filed on Jan. 9, 2004.

(51) Int. Cl.
*B68C 1/16* (2006.01)

(52) U.S. Cl. ..... 54/46.1

(58) Field of Classification Search ..... 54/46.1, 54/46.2, 44.1, 41.1; D30/134, 135, 142; 16/110.1, 421, 430, DIG. 12; D8/303, 315–318
See application file for complete search history.

(56) References Cited

U.S. PATENT DOCUMENTS 3,438,177 A * 4/1969 Houston ..... 54/23
D215,276 S * 9/1969 Spargo ..... D8/307
4,155,582 A * 5/1979 Reisner ..... 294/58
4,506,496 A 3/1985 Olson
4,905,458 A 3/1990 Johnston et al.
5,048,272 A 9/1991 Saare
5,187,924 A 2/1993 Marshall
5,651,240 A * 7/1997 Tompkins ..... 54/44.1
6,145,478 A * 11/2000 Boyd et al. ..... 119/725
6,568,940 B1 5/2003 Mack

FOREIGN PATENT DOCUMENTS

DE 29918070 U1 * 2/2000
GB 2110514 A * 6/1983

* cited by examiner

*Primary Examiner*—Son T. Nguyen
(74) *Attorney, Agent, or Firm*—W. Scott Carson

(57) ABSTRACT

An improved handgrip and stirrup support device for bareback horse riding. The device comprises a handgrip having opposing arms to which are attached at an angle side members having openings therein. The handgrip is improved by being made generally straight and elongated and by having ridges formed into the handgrip. The handgrip is further improved by having opposing arms to increase the elevation of the handgrip over the side members. The side members are improved by having a greater surface area. The openings in the side members are improved so that a hand can enter the openings to adjust a girth and so that a breastplate can be attached to the device. The improvements enable the device to be used with any horse and increase the security and comfort of the device for both the horse and the rider.

16 Claims, 5 Drawing Sheets

8
18
12
13
14
10
16
5
34
30
26
28
27
8

12
13
14
14
10
18
24
20
20
20
20
A
16
24
16
22
29
22
29

Fig. 3
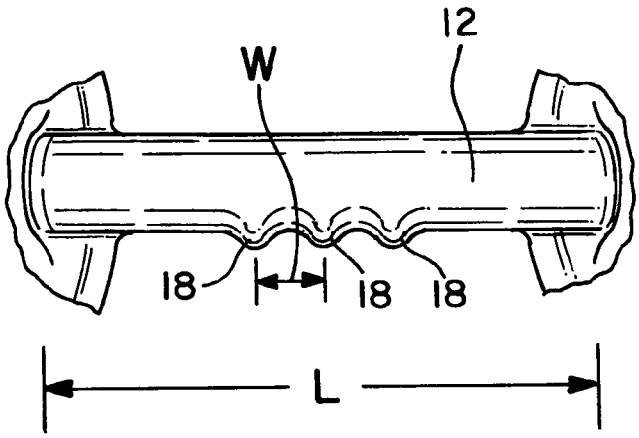
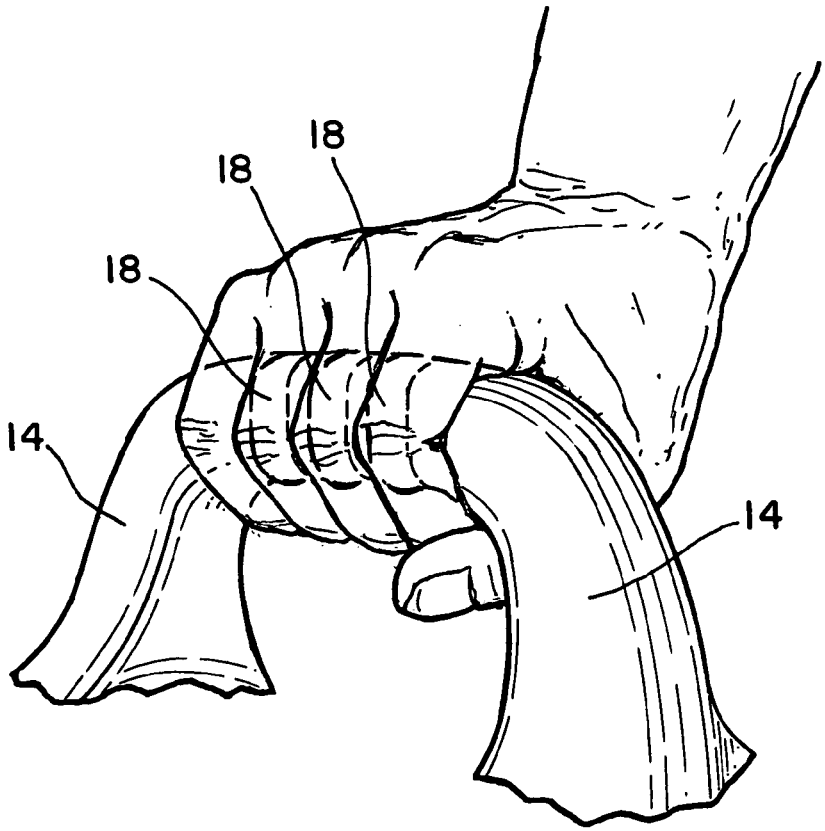
Fig. 4

HANDGRIP AND STIRRUP SUPPORT FOR BAREBACK HORSE RIDING

RELATED INVENTION

This application claims priority to Provisional Patent Application Ser. No. 60/535,630, filed Jan. 9, 2004, and entitled "HANDGRIP AND STIRRUP SUPPORT IMPROVEMENT."

BACKGROUND OF THE INVENTION

1. Field of the Invention

This invention relates generally to an improved handgrip and stirrup support device for bareback horse riding.

2. Discussion of the Background

Horseback riding has long enjoyed wide popularity. Those who ride for leisure or for sport often prefer the challenge and the feel of riding "bareback." However, while riding without a saddle makes riding more enjoyable to many, it poses certain difficulties for the horse and rider that can be disadvantageous. Typically, a rider with no stirrups or handgrip must grip the horse very tightly with his legs in order to maintain his balance. While this gripping helps to keep the rider from falling off the horse, or from being thrown, it can be very tiring after sustained periods of riding. In addition, it can be uncomfortable for the horse. Nor does it provide complete security to even the most experienced riders, should the horse buck or rear unexpectedly. Stability for the rider is particularly important, and especially where the safety of a novice, a child, or a handicapped person is concerned.

The type of apparatus that has been previously used to help surmount some of these problems associated with bareback riding is shown in U.S. Pat. Nos. 4,506,496, 4,905,458, 5,048,272, 5,187,924, and 6,568,940.

SUMMARY OF THE INVENTION

In order to overcome the problems and disadvantages inherent in the prior devices hereinbefore described, the present invention provides an improved handgrip and stirrup support device for use during the bareback riding of horses. The device comprises an inverted generally U-shaped or wishbone-shaped member that functions as a handgrip for the rider, to which are attached two stirrup straps for supporting two stirrups. The device is secured to the horse with a girth that is attached directly to the device on both sides. The improved device comprises at least one opening in the device of sufficient width such that the hand of the rider or other person can be inserted in the opening to adjust the girth. The improved device further comprises a breastplate that is attached directly to the device.

The device is very lightweight, and highly economical. In addition, the shape and size of the device allow very comfortable and convenient placement over the withers of any horse while leaving sufficient space between the withers and the handgrip. The shape and size of the device allows very comfortable and secure placement on the barrel of any horse. The device improves the comfort and security of the rider. The device also serves several generally useful functions. It can be used by a trainer during the training of the horse with or without a rider. It can also aid the rider in mounting the animal, and it is a substitute for a conventional saddle during riding. The device discourages the horse from lying down and then rolling over onto its back.

The device comprises an inverted generally U-shaped or wishbone-shaped member. The upper portion of the wishbone is an upright, horizontal design to function as a secure and comfortable handgrip for the rider, and to serve simultaneously as a point of union for the two lower, downwardly extending portions of the wishbone. The two downwardly extending portions comprise side members that rest against the horse's body. The side members have at least one opening formed therein. Attached to these side members, by means of being attached to certain of the openings, are two stirrup straps for supporting two stirrups. The device is secured to the horse with a girth that is attached to certain of the openings. The device can be further secured to the horse with a breastplate that is attached to certain of the openings.

The overall simplicity in construction and the use of lightweight materials result in a secure, comfortable, lightweight, and economical device.

BRIEF DESCRIPTION OF THE DRAWINGS

FIG. 3 is a top view of the handgrip showing the ridges.

FIG. 4 is a perspective view of the handgrip showing how a human hand grasps the handgrip using the ridges.

DETAILED DESCRIPTION OF THE INVENTION

Figure 1:
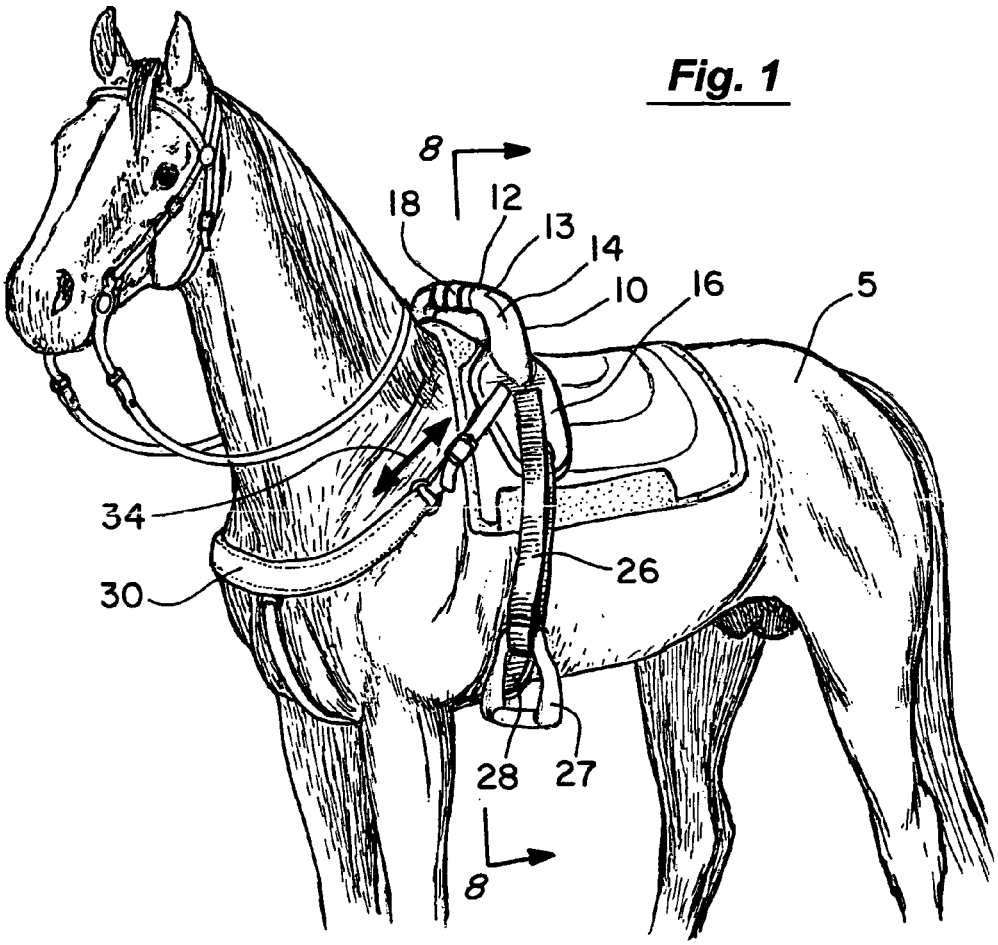
FIG. 1 is a perspective view of the new and improved handgrip and stirrup support device when positioned on a horse's back.
Figure 2:
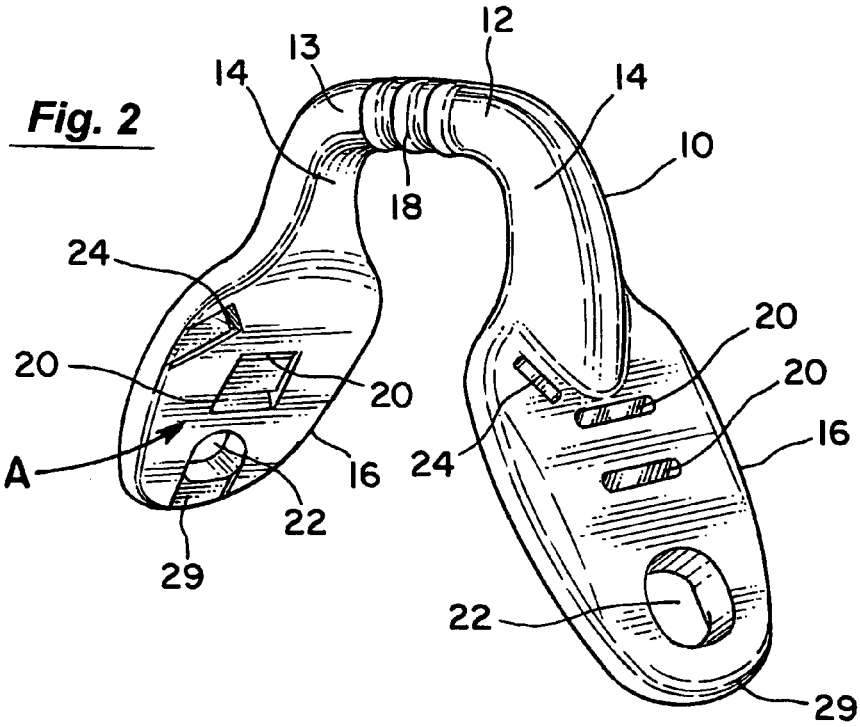
FIG. 2 is a perspective view of the handgrip and stirrup support device.

Referring now to FIG. 1, there is shown fastened to a horse 5 the improved handgrip and stirrup support device 10. The device 10 is an inverted generally U-shaped or wishbone-shaped member, made in one embodiment of a plastic material. Other materials may be used to make the device within the scope of the invention as will be evident to those skilled in the art. As shown in FIG. 2, the device 10 comprises a handgrip 12. Downwardly extending opposing arms 14 are connected to the handgrip 12. The handgrip 12 serves as a union for the side members 16 that are connected to and extend downwardly from the arms 14, and the entire device 10 is an integral piece.

FIGS. 2, 3, 4, 5, 6, and 7 illustrate detailed views of the device 10 and its principal parts. The handgrip 12 has a generally rounded cross-section to increase the ability of the rider to obtain a secure grip with his hand and to increase the comfort to the rider when gripping the handgrip 12, as shown in FIG. 4. The handgrip 12 is different in shape from those handgrips described in the prior art. That is, in the prior art, handgrips were often semicircular. In the present invention, however, the handgrip 12 is elongated and generally straight for a length L (see FIG. 3) such that a rider's hand can comfortably grasp the handgrip 12, as shown in FIG. 4. This improvement increases the security of the grip of the rider as discussed in more detail below, and also increases the comfort of the rider when gripping the handgrip 12. The handgrip 12 has a length L of between about 6 inches (about 15 centimeters) and about 12 inches (about 30.5 centimeters), as shown in FIG. 3.

Figure 5:
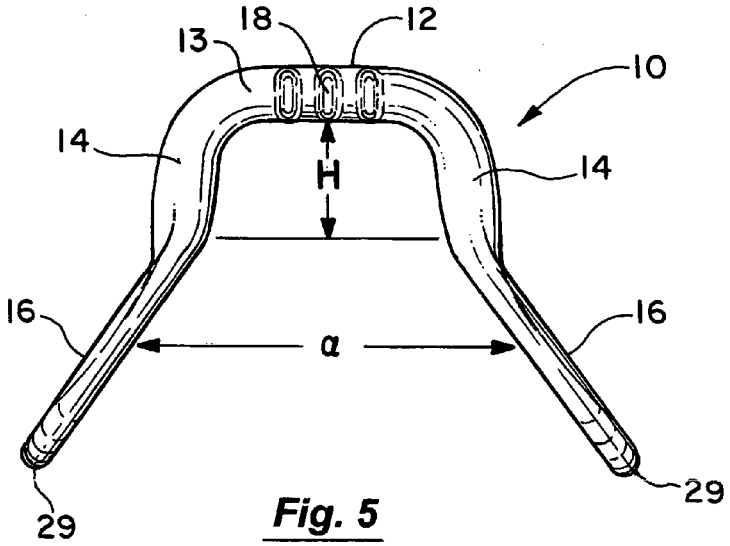
FIG. 5 is a front view of the handgrip and stirrup support device.
Figure 7:
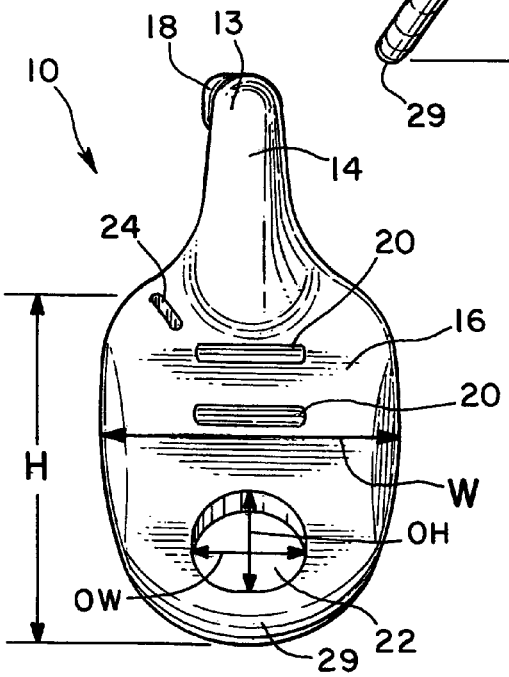
FIG. 7 is a side view of the handgrip and stirrup support device.

The handgrip 12 comprises a front portion 13 as shown in FIGS. 5 and 7. The front portion 13 is generally oriented toward the head of the horse 5 when the device 10 is mounted on the horse 5, as can be seen in FIG. 1. Ridges 18 are formed into the front portion 13 of the handgrip 12, although it is to be understood that ridges 18 can be formed into any portion of or all of the handgrip 12. The ridges 18 are generally centered between the opposing arms 14. Any number of ridges 18 can be used in the present invention. The ridges 18 are formed such that if more than one ridge 18 is present in the invention, the width W between the ridges 18 is sufficient for a human finger to fit securely between the ridges 18, as shown in FIGS. 3 and 4. For example, the width W between the ridges 18 can be about 1 inch (about 2.5 centimeters). The ridges 18 thus prevent the rider's hand from sliding along the length L of the handgrip 12. The ridges 18 thus improve the security of the rider's grip on the handgrip 12.

Figure 11:
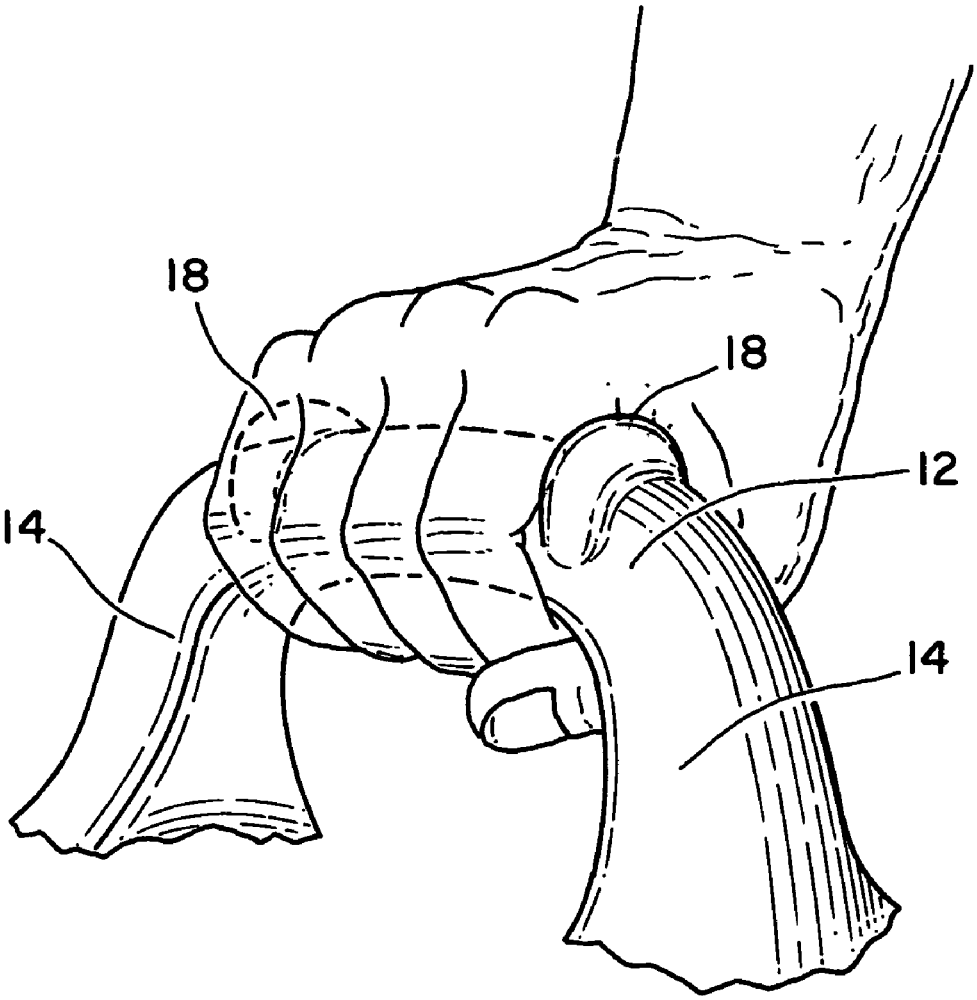
FIG. 11 is a perspective view of the handgrip showing how a human hand grasps the handgrip using the ridges.

Other methods of improving the security of the rider's grip on the handgrip 12 will be evident to those skilled in the art and are considered to be included in the scope of the invention. For example, but not limited to, a roughened area could be made on the surface of the handgrip 12; material such as leather could be wrapped around or otherwise attached to the handgrip 12; ties could be used to form a band tied over the rider's hand; an opening could be formed in the handgrip into which a rider's hand could be inserted; two ridges could be formed in the handgrip 12 such that they would rise on either side of the rider's hand (see FIG. 11) or even extend over the hand when the hand grips the handgrip 12; and/or a sticky or tacky substance could be applied to the handgrip 12.

Opposing arms 14 are connected to the handgrip 12 and extend downwardly from the handgrip 12. The opposing arms 14 have a height H of between about 4 inches (about 10 centimeters) and about 6 inches (about 15 centimeters), as shown in FIG. 5.

Figure 6:
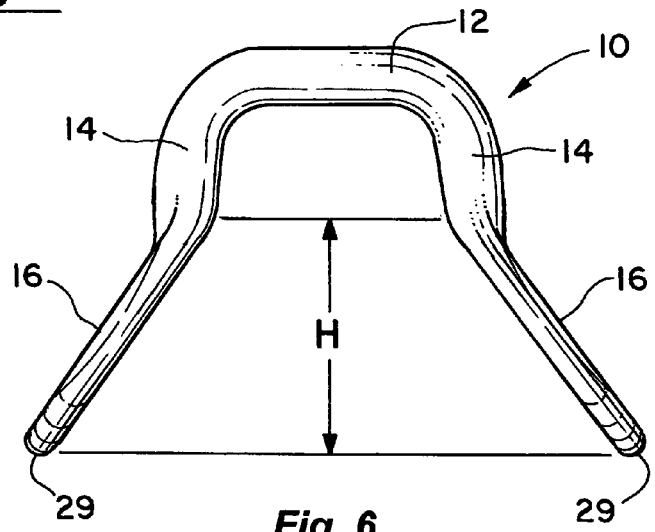
FIG. 6 is a rear view of the handgrip and stirrup support device.

A side member 16 is connected to each of the opposing arms 14, and the side member 16 extends downwardly from the arm 14, as seen in FIG. 2. The side member 16 has a generally ovoid shape and is enlarged, that is, greater in surface area A, compared with prior art side members. The height H and the width W of the side member 16 used to calculate the surface area A are shown in FIG. 7. Each of the side members 16 of the improved invention has a height H between about 8 inches (about 20 centimeters) and about 12 inches (about 30.5 centimeters) and a width W of between about 6 inches (about 15 centimeters) and about 10 inches (about 25.5 centimeters), as shown in FIGS. 6 and 7.

Figure 8:
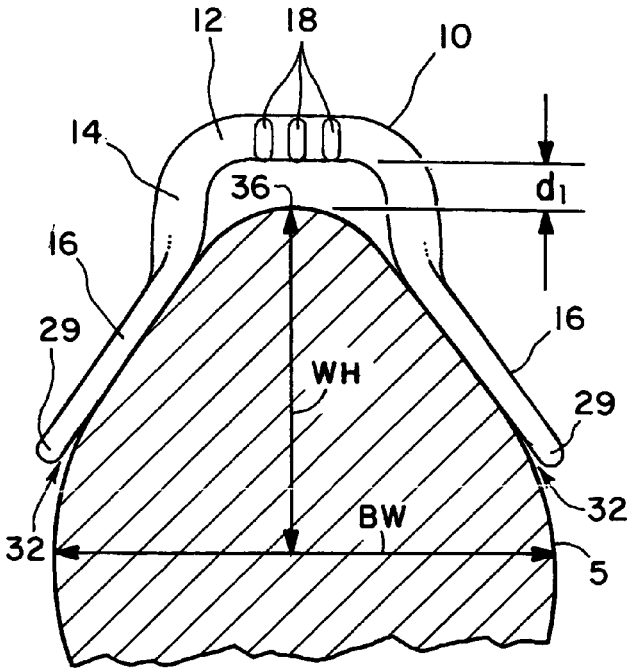
FIGS. 8, 9 and 10 are cross-sectional views taken along line 8—8 in FIG. 1, and show how the device fits horses of different barrel widths and different wither heights.
Figure 9:
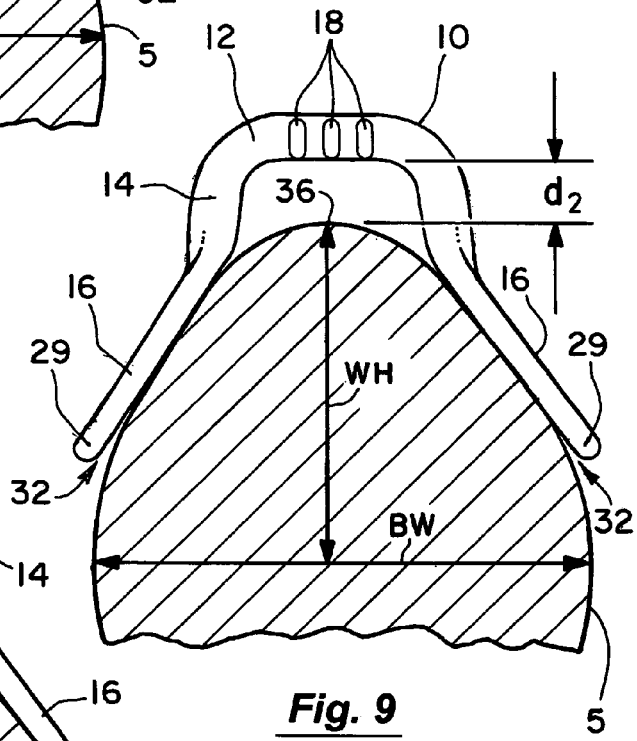
Figure 10:
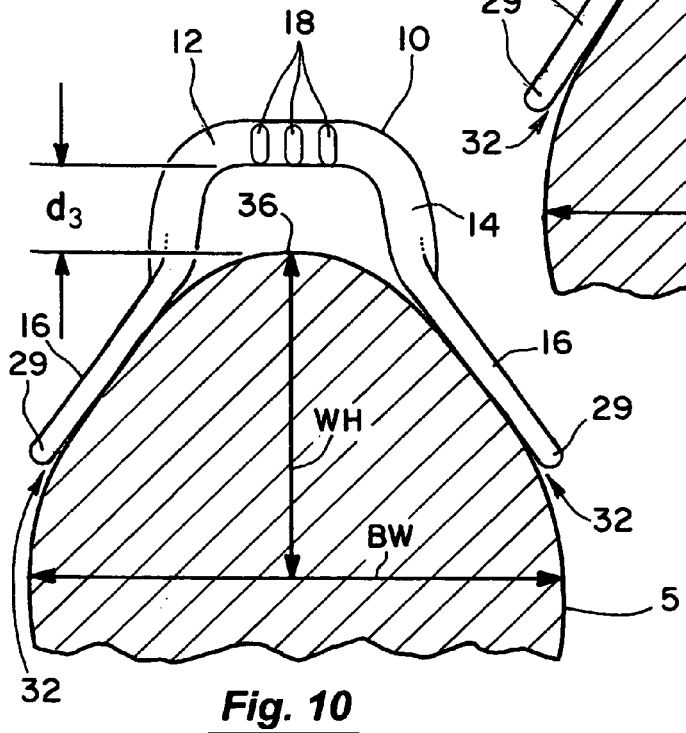

The side members 16 are angled a away from each other at an angle sufficient to allow the side members 16 to rest comfortably on the sides of any horse 5, as shown in FIGS. 8–10. The angle $\alpha$ of the side members 16 also permits the girth 28 to be more easily adjusted, as discussed in greater detail hereinbelow.

The oval shape and greater surface area A of the side members 16 comprise improvements over the prior art in that the surface area A for engagement on the side of the horse 5 is greater, making the device 10 more stable and secure when attached to the horse 5. The greater surface area A of the side members 16 also is more comfortable both for the horse 5, because the weight of the rider is borne over a corresponding larger area on the side of the horse 5, and for the rider, because the rider's legs are less likely to rub against the edges of the side members 16. The oval shape means that there are no sharp corners in the side members 16 to poke into either the horse 5 or the rider.

At least one opening 20, 22, 24 is formed into each side member 16 as shown in FIGS. 2 and 7. Opening 20 is provided to receive a stirrup strap 26. Opening 22 is provided to receive a girth 28. Opening 24 is provided to receive a breastplate 30. The attachments of a stirrup strap 26 with a stirrup 27, of a girth 28, and of a breastplate 30 to a side member 16 are shown in FIG. 1.

A stirrup strap 26 is attached to each side member 16 as shown in FIG. 1. The stirrup strap 26 may be made of any conventional material that is known in the art to make stirrup straps that are suitable for riding. For example, but not limited to, the stirrup strap 26 may be made of nylon webbing or leather or rubber or an elastic material. The stirrup strap 26 supports a stirrup 27. The stirrup 27 can be made of any conventional material that is known in the art to make stirrups. For example, but not limited to, the stirrup 27 can be made of metal, leather, wood, rubber, plastic, or other materials that will be known to those who are skilled in the art. The attachment of the stirrup strap 26 with the stirrup 27 to the side member 16 provides security and support for the rider using the device 10.

A stirrup strap 26 is attached to each side member 16 by being received in openings 20 (see FIG. 2). Openings 20 comprise two openings, one directly above the other, in the middle portion of each side member 16 between the bottom 29 of the side member 16 and the handgrip 12. Alternatively, at least one opening 20 having a bar extending across it may be formed into the side member 26 (not shown). Openings 20 are located such that stirrup straps 26 can be attached securely to the side members 16 as shown in FIG. 1, with most of the stirrup strap 26 lying on the outside of the side member 16, increasing the comfort of the device 10 for the horse 5. In addition, when the stirrup strap 26 is attached in this manner, it lies substantially flat over the side member 16, resulting in increased comfort for the rider's leg. The stirrup strap 26 can also be attached to the side member 16 by any conventional method as will be evident to those skilled in the art.

The device 10 is secured to a horse 5 by a girth 28 that is received in openings 22 (see FIG. 2) formed in the side members 16, as shown in FIG. 1. The girth 28 can be made of any conventional material that is known in the art to make girths. For example, the girth 28 may be made of leather, nylon webbing, string, rubber, elastic material, or other materials that will be known to those who are skilled in the art.

Opening 22 comprises an improvement in the present invention over the prior art. Opening 22 is placed near the end 29 of each side member 16 so that a girth 28 can be attached to each side member 16. Opening 22 is shaped as a slightly rounded square that is larger than prior openings. Opening 22 has a height OH of between about 2 inches (about 5 centimeters) and about 4 inches (about 10 centimeters) and a width OW of between about 2 inches (about 5 centimeters) and about 4 inches (about 10 centimeters), as shown in FIG. 7. The size of the opening 22 enables one's fingers to be easily placed through the opening 22.

As described hereinabove and shown in FIG. 5, in another improvement in the present invention, the side members 16 are angled a away from each other (see FIG. 5). When the device 10 is mounted on a horse 5, as shown in FIGS. 8–10, a space 32 remains between the end 29 of the side member 16 and the side of the horse 5. The space 32 is sufficiently large for the person attaching the girth 28 to the side member 16 to reach underneath the side member 16 and access opening 22, which receives the girth 28.

Thus, opening 22 is accessible from both sides of the side member 16 when the device 10 is mounted on a horse 5, and the opening 22 is sufficiently large for one's hand to be placed through the opening 22. This improved accessibility enables the girth 28 to be more easily and securely attached and adjusted to the particular horse 5 on which the device 10 is used. The attachment of the girth 28 may be made by any manner known to those skilled in the art, including but not limited to buckles, ties, snaps, knotting, and the like. The attachment of the girth 28 to the side members 16 and the ability to adjust the girth 28 by accessing the opening 22 provides an improvement in the security and the stability of the attachment of the device 10 to the horse not found in the above-presented prior art.

The opening 24 is formed into each side member 16 adjacent to the arm 14 of the handgrip 12 (see FIG. 2). As shown in FIG. 7, the opening 24 is formed in a slanted position, with the upper end of the opening 24 closer to the front of the side member 16 and with the lower end of the opening 24 closer to the rear of the side member 16. Such a position of the opening 24 enables a breastplate 30 to be attached to the side members 16 in a secure fashion. The slanted position of the opening 24 enables the breastplate 30 to be attached at an angle (arrows 34 in FIG. 1) that allows the breastplate 30 to lie in the proper position against the chest of the horse 5. However, it is to be understood that the opening 24 can be of any shape, size, or position or on any location on the device 10 that will enable a breastplate 30 to be attached to the device 10. The ability to attach a breastplate 30 to the device 10 is an improvement over the prior art presented herein. For example, the breastplate 30 provides improved stability and security of the device 10 and the rider when the horse 5 rears, accelerates, or makes a turn. Other methods of attaching a breastplate 30 to the device 10 will be evident to those skilled in the art, such as, but not limited to, brackets, posts, buckles, d-rings, and the like.

Another improvement of the present invention is shown in FIGS. 8, 9, and 10. That is, prior handgrips were often too short in length L (see FIG. 3) and too low in height H (see FIG. 5) to enable the device 10 to fit on horses 5 having different barrel widths BW or wither heights WH. That is, some horses 5 may have narrow barrel widths BW, and some horses 5 may have wider barrel widths BW. Some horses 5 may have low wither heights WH, and some horses 5 may have high wither heights WH. An infinite number of different combinations of barrel widths BW and wither heights WH are to be expected. The device 10 of the present invention is shaped such that the device 10 will fit a horse 5 having any barrel width BW and any wither height WH. This is achieved by increasing the length L and height H of the handgrip 12, as shown in FIGS. 3 and 5, over those dimensions in prior handgrips. That is, the handgrip 12 is elongated and elevated compared with those of the prior art. The handgrip 12 has a length L of about 12 inches (about 30.5 centimeters), and the opposing arms have a height H of between about 4 inches (about 10 centimeters) and about 6 inches (about 15 centimeters).

For example, FIG. 8 shows a cross-section of the device 10 placed on a horse 5 with a narrow barrel width BW and high wither height WH. The distance d1 between the bottom of the handgrip 12 and the top of the withers is sufficient for the handgrip 12 to clear the top 36 of the withers with room to spare. FIG. 9 shows an average-sized horse 5. The distance d2 is sufficient for the handgrip 12 to clear the top 36 of the withers. FIG. 10 shows a horse 5 with a wider barrel width BW and lower wither height WH. The distance d3 is sufficient for the handgrip 12 to clear the top 36 of the withers.

In addition, it can be seen in FIGS. 8–10 that the length L of the handgrip 12 is such that the device 10 rests comfortably and securely on the sides of the barrel of the horse 5 no matter how wide the barrel width BW may be. That is, in every case illustrated in FIGS. 8–10, the side members 16 have almost their entire surface area A contacting the side of the horse 5. This is an improvement over the prior art in the security of the attachment and in the comfort of the device 10 to the horse 5.

Thus, the invention comprises an improved handgrip and stirrup support device 10 having a handgrip 12, side members 16 connected to said handgrip 12 at an angle a, said side members 16 having a girth 28 and stirrup straps 26 attached thereto, said device 10 for use by riders while riding horses, wherein the improvement comprises an elongated handgrip 12 having a length L of about 12 inches (about 30.5 centimeters) so that said handgrip 12 can span the withers 36 of a horse 5 when said device 10 is mounted on said horse 5 despite variations in the barrel width BW and withers height WH of said horse 5, said handgrip 12 comprising a front portion 13; opposing arms 14 connected to said handgrip 12, said arms 14 having a height H of between about 4 inches (about 10 centimeters) and about 6 inches (about 15 centimeters) to position said handgrip 12 a sufficient distance above the withers 36 of a horse 5 when said device 10 is mounted on said horse 5 to provide a space between said handgrip 12 and said withers 36 despite variations in the barrel width BW and withers height WH of said horse 5; ridges 18 formed into said front portion 13 of said handgrip 12, said ridges 18 centered on said handgrip 12 between said opposing arms 14; said ridges 18 having a width W of about 1 inch (about 2.5 centimeters) so as to enable secure grasping of said handgrip 12 by a hand of a rider; a side member 16 connected at an angle a to each of said opposing arms 14, each of said side members 16 having a height H of about 8 inches (about 20 centimeters) and a width W of about 6 inches (about 15 centimeters), so that said side member 16 rests securely against the side of a horse 5 when the device 10 is mounted on said horse 5; each of said side members 16 having at least one opening 22 formed therein to receive a girth 28, said opening 22 having a height of between about 2 inches (about 5 centimeters) and about 4 inches (about 10 centimeters) and a width of between about 2 inches (about 5 centimeters) and about 4 inches (about 10 centimeters), so that a hand can enter said opening 22 to adjust said girth 28; each of said side members 16 having at least one opening 20 formed therein to receive a stirrup strap 26 with a stirrup 27, so that a rider can have a secure seat on said horse 5; and a breastplate 30 attached to said side members 16 so that said device 10 can be securely fastened to said horse 5.

The device 10 is used by riders while riding horses, by first providing an improved handgrip and stirrup support device 10; forming ridges 18 into said handgrip 12, said handgrip having a length L of about 12 inches (about 30.5 centimeters) so that said handgrip 12 can span the withers 36 of a horse 5 when said device 10 is mounted on said horse 5 despite variations in the barrel width BW and withers height WH of said horse 5; connecting opposing arms 14 to said handgrip 12, said arms 14 having a height H of between about 4 inches (about 10 centimeters) and about 6 inches (about 15 centimeters) to position said handgrip 12 a sufficient distance above the withers 36 of a horse 5 when said device 10 is mounted on said horse 5 to provide a space between said handgrip 12 and said withers 36 despite variations in the barrel width BW and withers height WH of said horse 5; connecting a side member 16 to each of said opposing arms 14 at an angle α, said side member 16 having at least one opening 20, 22, 24 formed therein; mounting said device 10 on the back of a horse 5 over the withers 36; attaching stirrup straps 26 with stirrups 27 to said side members 16 with said openings 20; attaching a girth 28 to said side members 16 with said openings 22, said openings 22 allowing said girth 28 to be adjusted; attaching a breastplate 30 to said side members 16 with said openings 24; so that said device 10 can be securely fastened to said horse 5 and so that a rider can have a secure seat on said horse 5.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A handgrip support device for horseback riding comprising:

a handgrip, said handgrip having a front portion and a rear portion substantially opposite said front portion, said front portion having ridges formed therein and said rear portion being substantially smooth;

arms connected to said handgrip;

side members connected at an angle to said arms, said side members having at least one opening formed therein; and a breast plate attached to at least one of said side members and received in said at least one opening formed therein.

2. The device of claim 1 further comprising at least a second opening formed in each side member and a stirrup strap attached to at least one of said side members and received in said second opening formed therein.

3. The device of claim 1 further comprising at least a second opening formed in each side member and a girth attached to said at least one of said side members and received in said second opening formed therein.

4. The device of claim 1 wherein at least one of said ridges is formed near said arms.

5. The device of claim 1 wherein said handgrip comprises a roughened surface.

6. A handgrip support device for horseback riding comprising:

an elongated handgrip and opposing arms connected to said elongated handgrip, said elongated handgrip having a front portion and a rear portion substantially opposite said front portion, said front portion having ridges formed therein extending along said elongated handgrip and said rear portion being substantially smooth along said elongated handgrip, said ridges being substantially centered on said elongated handgrip between said opposing arms;

a side member connected to each of said opposing arms;

each of said side members having at least one opening formed therein; and a breast plate attached to at least one of said side members and received in said at least one opening formed therein.

7. The device of claim 6 further comprising:

each of said side members having at least a second opening formed therein to receive a girth, so that said device can be securely fastened to said horse.

8. The device of claim 6 further comprising:

each of said side members having at least a second opening formed therein to receive a stirrup strap with a stirrup, so that a rider can have a secure seat on said horse.

9. The device of claim 6 wherein each of said side members is connected to each respective opposing arm at an angle and said elongated handgrip is formed in substantially a straight line.

10. A handgrip and stirrup support device comprising:

an elongated handgrip;

opposing arms connected to said handgrip, said opposing arms of a sufficient height to position said handgrip above the withers of a horse when said device is mounted on said horse despite variations in the barrel width and withers height of said horse;

a side member connected to each of said opposing arms;

each of said side members having at least one, substantially elongated opening formed therein to receive a stirrup strap with a stirrup so that a rider can have a secure seat on said horse;

each of said side members having at least one, substantially rounded opening formed therein in to receive a girth, said opening being substantially larger than the elongated opening of each side member receiving said stirrup strap and having a width sufficient for a human hand to enter said opening, so that said girth can be easily adjusted so that said device can be securely fastened to said horse.

11. The device of claim 10 wherein each of said side members has at least one, substantially elongated opening formed therein to receive a breastplate so that said device can be securely fastened to said horse, said opening for receiving said girth being substantially larger than the elongated opening of each side member receiving said breastplate.

12. A handgrip and stirrup support device comprising:

an elongated handgrip and opposing arms connected to said elongated handgrip, said elongated handgrip having a length L of about 12 inches (about 30.5 centimeters), said elongated handgrip having a front portion and a rear portion substantially opposite said front portion, said front portion having ridges formed therein extending along said elongated handgrip and said rear portion being substantially smooth along said elongated handgrip, said ridges being substantially centered on said elongated handgrip between said opposing arms, said ridges having a width W of about 1 inch (about 2.5 centimeters);

said arms having a height H of between about 4 inches (about 10 centimeters) and about 6 inches (about 15 centimeters);

a side member connected to each of said opposing arms, each of said side members having a height H of about 8 inches (about 20 centimeters) and a width W of about 6 inches (about 15 centimeters); each of said side members having at least one opening formed therein to receive a girth, said opening having a height of between about 2 inches (about 5 centimeters) and about 4 inches (about 10 centimeters) and a width of between about 2 inches (about 5 centimeters) and about 4 inches (about 10 centimeters);

each of said side members having at least one opening formed therein to receive a stirrup strap with a stirrup, so that a rider can have a secure seat on said horse.

13. The device of claim 12 further comprising a breastplate attached to said side members so that said device can be securely fastened to said horse.

14. A handgrip and stirrup support device comprising:

an elongated handgrip having a length L of about 12 inches (about 30.5 centimeters) so that said handgrip can span the withers of a horse when said device is mounted on said horse despite variations in the barrel width and withers height of said horse, said handgrip having a front portion;

opposing arms connected to said handgrip, said arms having a height H of between about 4 inches (about 10 centimeters) and about 6 inches (about 15 centimeters) to position said handgrip a sufficient distance above the withers of a horse when said device is mounted on said horse to provide a space between said handgrip and said withers despite variations in the barrel width and withers height of said horse;

a side member connected to each of said opposing arms, each of said side members having a height H of about 8 inches (about 20 centimeters) and a width W of about 6 inches (about 15 centimeters) so that said side member rests securely against the side of a horse when the device is mounted on said horse;

each of said side members having at least one, substantially elongated opening formed therein to receive a stirrup strap with a stirrup so that a rider can have a secure seat on said horse, each of said side members having at least one opening formed therein to receive a girth, said opening being substantially larger than the elongated opening therein and having a height of between about 2 inches (about 5 centimeters) and about 4 inches (about 10 centimeters) and a width of between about 2 inches (about 5 centimeters) and about 4 inches (about 10 centimeters) so that a hand can enter said opening to adjust said girth.

15. The device of claim 14 further comprising a breastplate attached to said side members so that said device can be securely fastened to said horse.

16. The device of claim 14 wherein said handgrip has ridges formed into said front portion thereof, said ridges being substantially centered on said handgrip between said opposing arms, said ridges having a width W of about 1 inch (about 2.5 centimeters) so as to enable secure grasping of said handgrip by a hand of a rider.

* * * * *